US006434752B1

(12) United States Patent
Adams

(10) Patent No.: US 6,434,752 B1
(45) Date of Patent: Aug. 20, 2002

(54) COVERING FOR A PORTION OF A HUMAN HEAD

(76) Inventor: Margaret Malvina Adams, 39 Caenant Ter., Skewon, Noath, SA10 6UP (GB)

( * ) Notice: Subject to any disclaimer, the term of this patent is extended or adjusted under 35 U.S.C. 154(b) by 0 days.

(21) Appl. No.: 09/958,578

(22) PCT Filed: Apr. 10, 2000

(86) PCT No.: PCT/GB00/01351

§ 371 (c)(1),
(2), (4) Date: Jan. 3, 2002

(87) PCT Pub. No.: WO00/60969

PCT Pub. Date: Oct. 19, 1999

(30) Foreign Application Priority Data

Apr. 8, 1999 (GB) ..... 9907961

(51) Int. Cl.[7] ..... A42B 1/00
(52) U.S. Cl. ..... 2/171; 132/200
(58) Field of Search ..... 2/171, 174, 410, 2/67, 68, 84, 88, 171.03, 171.1, 172, 181.4, 202, 204, 205, 207, 208, 209.11, 195.3, 918, DIG. 11; 132/200, 212

(56) References Cited

U.S. PATENT DOCUMENTS 1,619,772 A 3/1927 Thompson
2,421,934 A * 6/1947 Golfieri ..... 2/204
2,424,129 A 7/1947 Vincelle
2,804,695 A 9/1957 Scott
4,683,596 A 8/1987 Cole
5,249,308 A * 10/1993 Blume ..... 2/174
5,265,278 A 11/1993 Watanae
5,566,689 A * 10/1996 Yeater ..... 132/200
5,778,455 A 7/1998 Joseph
6,189,152 B1 * 2/2001 Lofton ..... 2/171

FOREIGN PATENT DOCUMENTS

GB 2248391 * 8/1992 ..... A47K/10/02

* cited by examiner

*Primary Examiner*—Gloria M. Hale
*Assistant Examiner*—Tejash Patel
(74) *Attorney, Agent, or Firm*—Weiss & Weiss, P.C.; Philip M. Weiss

(57) ABSTRACT

A covering (2) for a portion of a human head (16) and its method of use is disclosed. The covering (2) is an envelope formed from a flexible material and provided with a mouth, the material defining the mouth of the envelop. The length of the edge (6) of the material defining the mouth being at least partially elastically extendable. The envelope and the mouth are dimensioned to allow a first portion (8) of the envelope to be placed over the top and back portion of a head (16) and a second portion (10) of the envelope to extend forwards of the head (16), such that on twisting of the second portion (10) of the envelope through at least 180° about an axis (18) extending forwards from the head, part of the second portion (10) of the envelope may be caused to overlie the first portion (8) of the envelope on the head.

9 Claims, 3 Drawing Sheets

COVERING FOR A PORTION OF A HUMAN HEAD

This invention relates to a covering for a portion of a human head, and in particular, for the back and top portion of a human head.

In the present invention the covering is in the form of an envelope formed from a flexible material and provided with a mouth. The material defines the mouth of the envelope and the length of edge of the material defining the mouth being at least partially elastically extendable. The envelope and the mouth are dimensioned to allow the first portion of the envelope to be placed over the top and back portion of a human head and a second portion of the envelope to extend forward of the head, such that on twisting of the second portion of the envelope through at least 180° about an axis extending forward from the head, part of the second portion of the envelope may be caused to overly the first portion of the envelope on the head.

Such a head covering may have a variety of uses. The particular use for which the head covering is intended will, in the large part, determine the nature of the material used to form the envelope. Such uses include the containment of wet hair, in which case the envelope will preferably be formed from towelling or other absorbent fabric material; the provision of warmth to the head in which case the envelope is preferably formed from a material with good heat insulation properties such as POLARFLEECE (a trade mark); or as an item of fashion wear in which case the envelope may be made of any material appropriate to the particular fashion.

It is most preferred that the envelope has a first and second portion. The first portion of the envelope is preferably configured and dimensioned to substantially match the contours of the back and top of the head. Accordingly, when the first portion of the envelope is placed over the back and top of the head, the first portion of the envelope fits closely to the back and top of the head. In an alternative embodiment that is particularly suitable for persons with long hair, the configuration and dimensioning of the first portion of the envelope is such that there is room in the first portion of the envelope when placed over the users head to contain all of that person's hair. It is particularly preferred that the material of the envelope has a degree of elasticity in all directions in the plane of the material.

It is preferred that the second portion of the envelope is larger than the first portion of the envelope. This is because when the second portion of the envelope has been twisted at least 180° about an axis extending forward from the head, the remaining portion of the envelope must be sufficiently large to be able to cover both the user's head and the first portion of the envelope. Again it is particularly preferred that the second portion of the envelope is configured and dimensioned to substantially match the contours of the back and top of the user's head when it has been used as discussed above. Alternatively, the second portion of the envelope may be configured to accommodate large quantities of hair in a similar fashion to the first portion.

The second portion of the envelope can be dimensioned and configured so as to fit over the user's head and first portion of the envelope after either a twist of about 180° about an axis extending forward from the user's head, or a multiple of 180°. In one embodiment, the covering can be made to suit a wide range of head sizes by varying the angle through which the second portion is twisted before being placed over the head of the user and the first portion of the envelope.

The edge of the material defining the mouth may either be fully elasticated or partially elasticated. Preferably the elastication is formed, in either case, by hemming the edge of the material so as to form a tube of material. Within that tube any elastic extensions means may be placed. Such means will be referred to hereafter as "elastic ribbon or string". The elastic ribbon or string is either continuous around the mouth of envelope or extends only partially around the mouth of the envelope. When the extension is only partial the ends of the elastic ribbon or string are anchored to the material of the envelope.

To use the covering of the present invention, a person places the first portion of the envelope over the back portion of a human head and extends the second portion of the envelope forward of the head. The user then twists the second portion of the envelope at least 180° about the axis extending forward from the head. Finally, the user causes the second portion of the envelope to overlie the first portion of the envelope on the head. Preferably at least the portion of the edge defining the mouth in the second portion of the envelope is elasticated so than when the second portion of the envelope is placed over the first portion of the envelope the edge of the mouth releasably grips the head and first portion of the envelope. This retains the covering on the wearer's head.

The present invention will be further described and explained by way of example in which.

Figure 1:
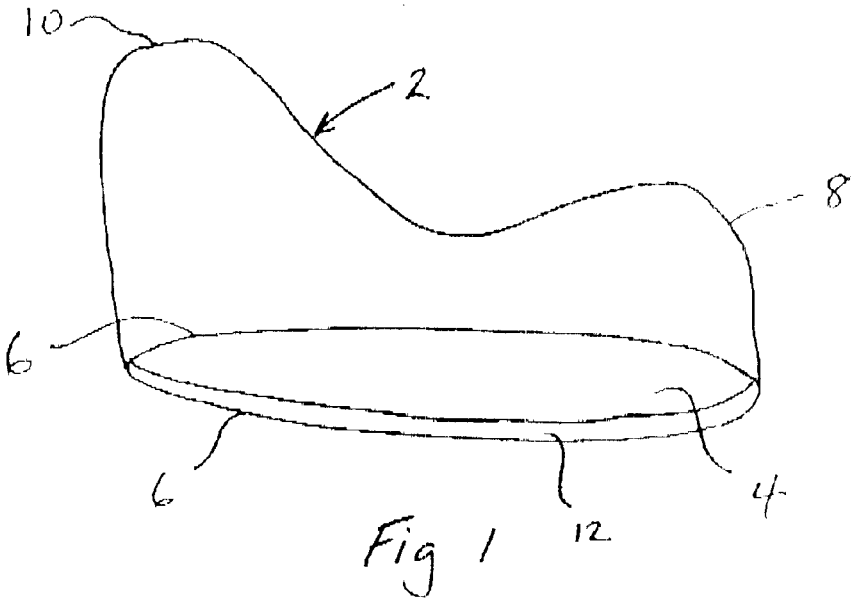
FIG. 1 shows a first embodiment of a covering according to the present invention.

With reference to FIG. 1, a covering of the present invention is formed from an envelope 2. Envelope 2 is made of a flexible, absorbent towelling material. A mouth 4 is defined by an edge 6 of the envelope 2.

Envelope 2 is formed from a first portion 8 and a second portion 10. First portion 8 is dimensionally smaller than second portion 10 as shown in FIG. 1.

Edge 6 of envelope 2 is formed into a tubular hem 12 that is continuous around edge 6. Within tubular hem 12 (and not shown) is an elastic ribbon or string. Edge 6 and tabular hem 12 are formed so that the length of edge 6 may be increased by applying tension along the edge 6 of the envelope 2.

Figure 2:
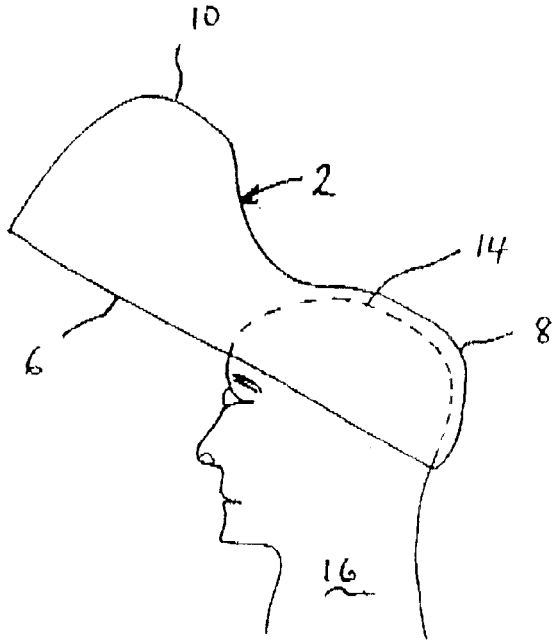
FIG. 2 shows the first stop in placing the covering of FIG. 1 on a human head.

As may be seen from FIG. 2, first portion 8 of envelope 2 is contoured and dimensioned so as to substantially match the contour 14 of the head and hair of an individual 16.

In use first portion 8 of the envelope 2 is placed over the back of the head of the individual 16 and the second portion 10 pulled forward of the head. The exact direction in which the second portion 10 is pulled is determined by where the user wishes edge 6 of envelope 2 to fall relative to the facial features of the individual 16.

Figure 3:
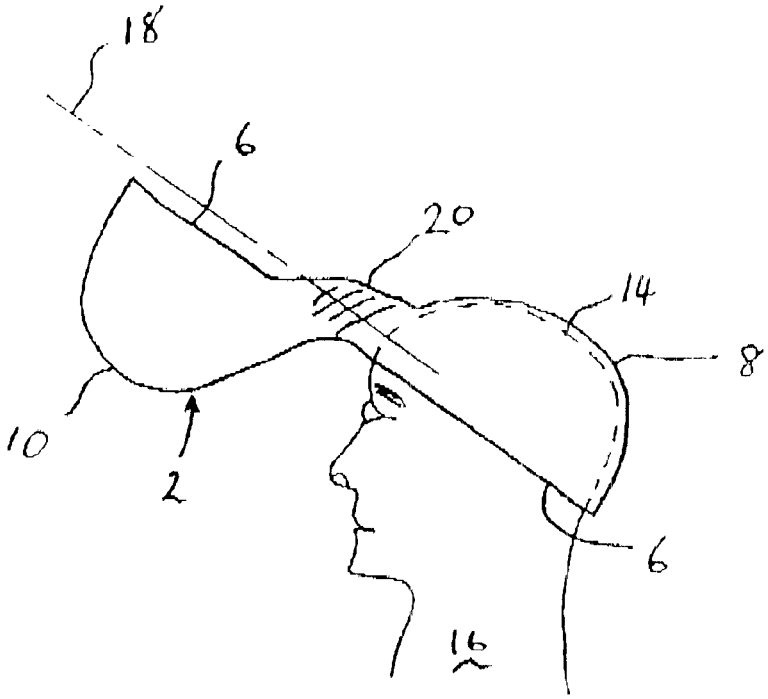
FIG. 3 shows the second step of placing a covering of FIG. 1 on a human head.

As shown in FIG. 3 the portion of second portion 10 adjacent to first portion 8 of envelope 2 is twisted through 180° about an axis 18 extending forward of the individual 16. The edge 6 of second portion 10 is, as shown in FIG. 3, now above the second portion 10.

Second portion 10 is then folded around twist 20 toward the head of individual 16 and caused to overlie the head of the individual 16 and first portion 8 of the envelope 2. This may be seen in FIG. 4.

The edge 6 of envelope 2 is, in this example, elasticated along its entire length and accordingly edge 6 will, assuming it has been extended by being placed around first portion 8 and the head of individual 16, grip the head of the individual 16. It is preferable that edge 6 is so dimensioned when in a non-extended state that the edge has to be a little extended when the covering of the present invention is in the configuration as shown in FIG. 4.

Figure 4:
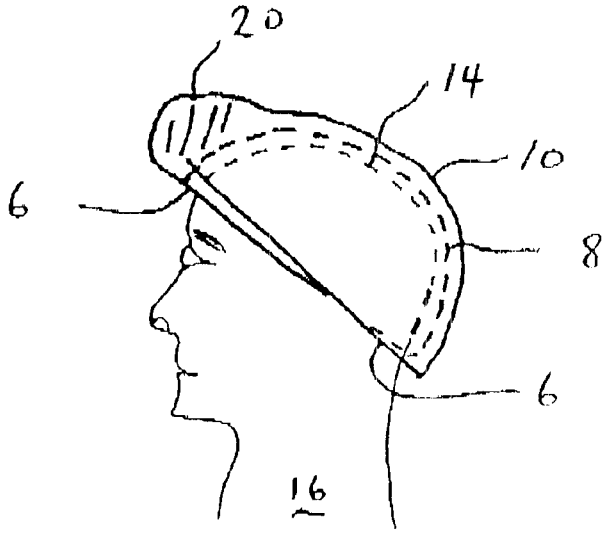
FIG. 4 shows the final stage of placing the covering of FIG. 1 on the human head.
Figure 5:
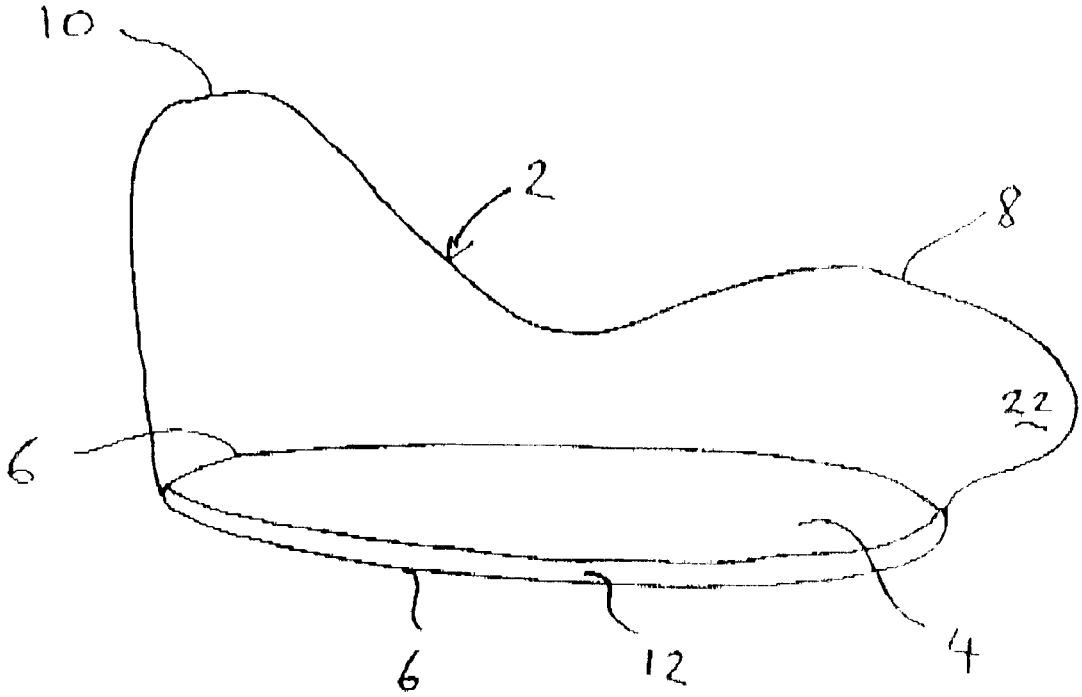
FIG. 5 shows a second embodiment of a covering according to the present invention.

The exact configuration of the envelope 2 may be varied depending upon both the purpose for which the covering of the present invention is required and the desired appearance of the covering when completed as in FIG. 4. The configuration shown in FIGS. 1 to 4 does not allow for the individual 16 to have particularly long hair. A configuration of envelope 2 as shown in FIG. 5 includes a portion 22 of first portion 8 of envelope 2 that will accommodate large amounts of long hair. The embodiment of FIG. 5 would be applied to an individual 16 in the same fashion as shown in FIGS. 2, 3 and 4.

What is claimed is:

1. A covering for a portion of a human head in which the covering is an envelope formed from a flexible material and provided with a mouth, said material defining the mouth of the envelope, a circumferential edge of the material defining the mouth as being at least partially elastically extendable, the envelope and the mouth being dimensioned to allow a first portion of the envelope to be placed over the top and back portion of a human head and a second portion of the envelope to extend forwards of the head, such that on twisting of the second portion of the envelope through at least 180° about an axis extending forwards from the head, part of the second portion of the envelope can be caused to substantially completely overlie the first portion of the envelope on the head.

2. A covering according to claim 1 in which the first portion of the envelope is configured and dimensioned to substantially match to the contours of the back and top of the head.

3. A covering according to claim 1 in which the second portion of the envelope is larger than the first portion of the envelope.

4. A covering according to claim 3 in which the second portion of the envelope is configured and dimensioned to substantially match the contours of the back and top of the head.

5. A covering according to claim 1 in which at least a portion of the edge of the material defining the mouth is hemmed so as to form a tube of material, within which tube is located an elastic ribbon or string.

6. A covering according to claim 5 in which the tube extends completely around the mouth of the envelope.

7. A covering according to claim 1 in which the material of the envelope is absorbent.

8. A covering according to claim 7, in which the material of the envelope is toweling.

9. A method of using a covering for a portion of a human head according to claim 1 consisting of the steps of:

placing a first portion of the envelope over the top and back portion of a human head and extending a second portion of the envelope forwards of the head;

twisting the second portion of the envelope through at least 180° about an axis extending forwards from the head; and causing the second portion of the envelope to substantially completely overlie the first portion of the envelope on the head.

* * * * *